US010912959B1

(12) United States Patent
Showalter

(10) Patent No.: US 10,912,959 B1
(45) Date of Patent: Feb. 9, 2021

(54) BREATHABLE RESPIRATOR MASK WITH AIR FILTERS AND OPENING COVERS

(71) Applicant: Edward Showalter, Los Angeles, CA (US)

(72) Inventor: Edward Showalter, Los Angeles, CA (US)

( * ) Notice: Subject to any disclaimer, the term of this patent is extended or adjusted under 35 U.S.C. 154(b) by 0 days.

(21) Appl. No.: 16/930,763

(22) Filed: Jul. 16, 2020

Related U.S. Application Data

(60) Provisional application No. 62/704,922, filed on Jun. 3, 2020.

(51) Int. Cl.
*A62B 18/08* (2006.01)
*A62B 23/02* (2006.01)
(Continued)

(52) U.S. Cl.
CPC ..... *A62B 18/086* (2013.01); *A62B 23/025* (2013.01); *A41D 13/11* (2013.01); *A62B 7/10* (2013.01); *A62B 18/025* (2013.01)

(58) Field of Classification Search
CPC ..... A62B 18/086; A62B 18/006; A62B 18/02; A62B 18/025; A62B 18/045; A62B 18/08; A62B 18/088; A62B 18/10; A62B 23/025; A62B 23/00; A62B 23/02; A62B 7/00; A62B 7/02; A62B 7/04; A62B 7/10; A62B 7/12; A62B 9/00; A62B 9/02; A62B 9/04; A62B 9/06; A61M 16/06; A61M 16/0605; A61M 16/0622; A61M 16/0875; A61M 2016/0661; A47G 21/18; A47G 21/189; B25G 1/04; A61J 1/1475
See application file for complete search history.

(56) References Cited

U.S. PATENT DOCUMENTS 2,540,567 A * 2/1951 Bennett ..... A61M 16/06 128/206.26
3,189,171 A * 6/1965 Miller ..... A47G 21/189 206/229

(Continued)

FOREIGN PATENT DOCUMENTS

JP 6615571 B2 * 12/2019

OTHER PUBLICATIONS

English Translation of JP6615571B2 provided by Espacenet, Translation Acquired Dec. 7, 2020, All Pages. (Year: 2015).*

*Primary Examiner* — Jan Christopher L Merene
*Assistant Examiner* — Brian T Khong
(74) *Attorney, Agent, or Firm* — Cionca IP Law P.C.; Marin Cionca

(57) ABSTRACT

A respirator oxygen mask having a filter, a mask body, an outer edge is described herein. Disposed in the mask body of the respirator oxygen mask is a mask opening and a straw opening, with the mask opening disposed above the straw opening. Additionally, a sliding door is adapted to cover the mask opening. The straw opening having a mask straw attachment adapted to receive a straw and a straw opening cover removably attached to the mask straw attachment. The respirator oxygen mask also having a face mask reduction attachment adapted to fasten to the outer edge. Furthermore, the mask body having a front surface with a hose attachment ring disposed over the filter and adapted to receive a tube and a rear surface with a filter holder and a filter cover to secure the filter in place.

19 Claims, 9 Drawing Sheets

(51) Int. Cl.

| | |
|---|---|
| ***A62B 18/02*** | (2006.01) |
| ***A41D 13/11*** | (2006.01) |
| ***A62B 7/10*** | (2006.01) |

(56) References Cited

U.S. PATENT DOCUMENTS 3,771,534 A * 11/1973 Kuehne ..... A24F 13/06 131/187
4,187,893 A * 2/1980 Bujan ..... A61J 1/1406 215/247
4,508,367 A * 4/1985 Oreopoulos ..... A61M 39/14 138/109
4,657,182 A * 4/1987 Hoshi ..... A47G 21/189 239/33
4,841,963 A * 6/1989 Vandeputte ..... A62B 18/086 128/202.15
4,922,931 A * 5/1990 Nare ..... A24F 13/02 131/211
5,135,489 A * 8/1992 Jepson ..... A61J 1/2089 600/578
5,433,192 A * 7/1995 Ebeling ..... A41D 13/11 128/201.13
5,810,398 A * 9/1998 Matkovich ..... A61M 39/1011 285/3
5,921,239 A * 7/1999 McCall ..... A61M 16/06 128/205.25
6,386,198 B1 * 5/2002 Rugless ..... A62B 18/10 128/205.25
7,958,889 B1 * 6/2011 Fernandez-DeCastro ..... A62B 18/086 128/202.15
10,625,102 B1 * 4/2020 Chen ..... A41D 13/1161
2002/0022808 A1 * 2/2002 Horn ..... A62B 18/086 604/247
2002/0123736 A1 * 9/2002 Fowles ..... A61J 1/1406 604/413
2005/0061822 A1 * 3/2005 Naesje ..... A47G 21/18 220/705
2005/0139220 A1 * 6/2005 Christopher ..... A61M 16/0495 128/207.14
2009/0084385 A1 * 4/2009 Lang ..... A62B 18/086 128/206.21
2011/0061656 A1 * 3/2011 Matich ..... A62B 23/025 128/206.25
2011/0061657 A1 * 3/2011 Matich ..... A62B 18/025 128/206.25
2011/0108613 A1 * 5/2011 Stribling ..... B65D 77/28 229/103.1
2011/0232646 A1 * 9/2011 Ho ..... A61M 16/1055 128/206.24
2013/0032153 A1 * 2/2013 Neely ..... A61M 16/06 128/205.25
2015/0202766 A1 * 7/2015 Light ..... A63B 47/02 16/429
2016/0038775 A1 * 2/2016 O'Neal Ward, Jr. .. A62B 18/02 128/206.12
2016/0129287 A1 * 5/2016 Danford ..... A62B 23/025 128/863
2016/0332008 A1 * 11/2016 McAndrews ..... A62B 18/084
2017/0106524 A1 * 4/2017 Ubeto ..... A46B 9/04
2017/0172137 A1 * 6/2017 Wynalda, Jr. ..... A62B 9/02
2018/0280758 A1 * 10/2018 Tao ..... A63B 21/00058
2019/0298608 A1 * 10/2019 Caetano ..... A61J 1/1425
2020/0039704 A1 * 2/2020 Habitz ..... B65D 47/128

* cited by examiner

BREATHABLE RESPIRATOR MASK WITH AIR FILTERS AND OPENING COVERS

CROSS-REFERENCE TO RELATED APPLICATIONS

This application claims the benefit of U.S. Provisional Application No. 62/704,922, filed Jun. 3, 2020, which is hereby incorporated by reference, to the extent that it is not conflicting with the present application.

BACKGROUND OF INVENTION

1. Field of the Invention

The invention relates generally to respirator oxygen masks, and more specifically to reusable respirator oxygen masks with openings for speaking, eating, and drinking purposes, while still protecting the user by filtering air through the mask. Furthermore, a respirator oxygen mask having an exhale inhale breathable filter, adjustable face sizing, and made of sustainable, renewable, eco-friendly bioplastic material.

2. Description of the Related Art

Currently, traditional cloth masks have fibers that are made from petroleum polymers which are toxic to humans. While other masks, such as oxygen masks or dust and bacteria filtering masks are made from toxic petroleum base polymers such as PET or PETE (polyethylene terephthalate). PVC is also another typical component of respirator masks, but it is also toxic to the user's health and environment. Additionally, personal protective equipment usually comes into contact with a large surface area of the user's face, which is uncomfortable and typically causes irritation to the user. This irritation usually causes a rash or a breakout of pimples.

Furthermore, studies have shown that wearing a mask for extended periods of time can cause headaches, lowered blood oxygen levels, along with difficulty to breath. These are all health concerns for the user, such as when lowered blood oxygen levels occur it reduces the immune system in humans. Usually, the side effects differ between cloth or paper surgical masks and $N^{95}$ respirator masks. Currently, N95 masks are a more widely recommended piece of personal protection equipment because of the N95 mask has a more effective filter. However, the more effective air filter also limits the user's ability to breath regularly and is therefore more commonly associated with the common side effects.

Additionally, typical N95 masks do not have an outgoing air filter. This means while a user is wearing an N95 mask they can expose the people around them to the viruses or bacteria they have. Studies have shown that healthcare workers who worn N95 masks experienced an increase in headaches during their workday. The healthcare workers also required pain medication to relieve the headache, and evidence pointed to the headaches being caused by reduced blood oxygenation, or an increase in carbon dioxide in the blood. The current issue of the N95 masks is the reduction of oxygen levels in the wearer. Having lower oxygen levels can lead to passing out a reduced natural immunity. Moreover, current masks do not filter the microplastic particles in the air users breathe. Another current issue is that patients that are receiving oxygen have no air filtration, meaning when they are wearing a typical oxygen mask, they are breathing out contaminated air. Thus, healthcare workers are at a greater risk when treating such patients that may be infected with a viral infection.

While current masks are also made from microplastics meaning as the user is wearing a mask, they are also ingesting even more microplastic particles. Current cloth masks have microplastic fiber particles and oxygen masks are currently made of PVC, which is one of the most toxic plastics. Also, while wearing current masks eating and drinking is not possible unless the mask is removed or moved to the side. Current masks also interfere while the user is speaking. For example, the user can have an urgent message to relay, but the mask inhibits quality verbal communication.

Therefore, there is a need to solve the problems described above by proving a device for filtering the user's inhale and exhale breathing, while also allowing the user to have access to the basic necessities such as eating, drinking, and typical oxygen levels.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a respirator oxygen mask, having a straw opening, a mask opening, a filter holder, a filter cover, and air filters is provided. The straw opening allows a straw to penetrate the mask, while the user is still wearing the mask. Thus, an advantage is the user is able to drink from a straw while still wearing the respirator oxygen mask. Additionally, the respirator oxygen mask has a mask opening that can move from an open to closed position. Thus, an advantage is the user can eat or speak while still wearing the mask. The filter holder and filter cover of the respirator oxygen mask allow the filters to be held in place and also allows the filters to be removed easily. Thus, an advantage is the user can eat while wearing the mask. Another advantage is the user can speak without a mask blocking their mouth to relay an urgent message.

In another aspect, a respirator oxygen mask, having face mask reduction attachment is provided. The face mask reduction attachment allows the respirator oxygen mask to be a more universal size because the face mask reduction attachment can be applied to the respirator oxygen mask to have a smaller face mask reduction attachment edge providing an airtight seal on a smaller surface. Thus, an advantage of the face mask reduction attachment is allowing the respirator oxygen mask to be a universal size, while also having the ability to be worn by other users' once sanitized.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
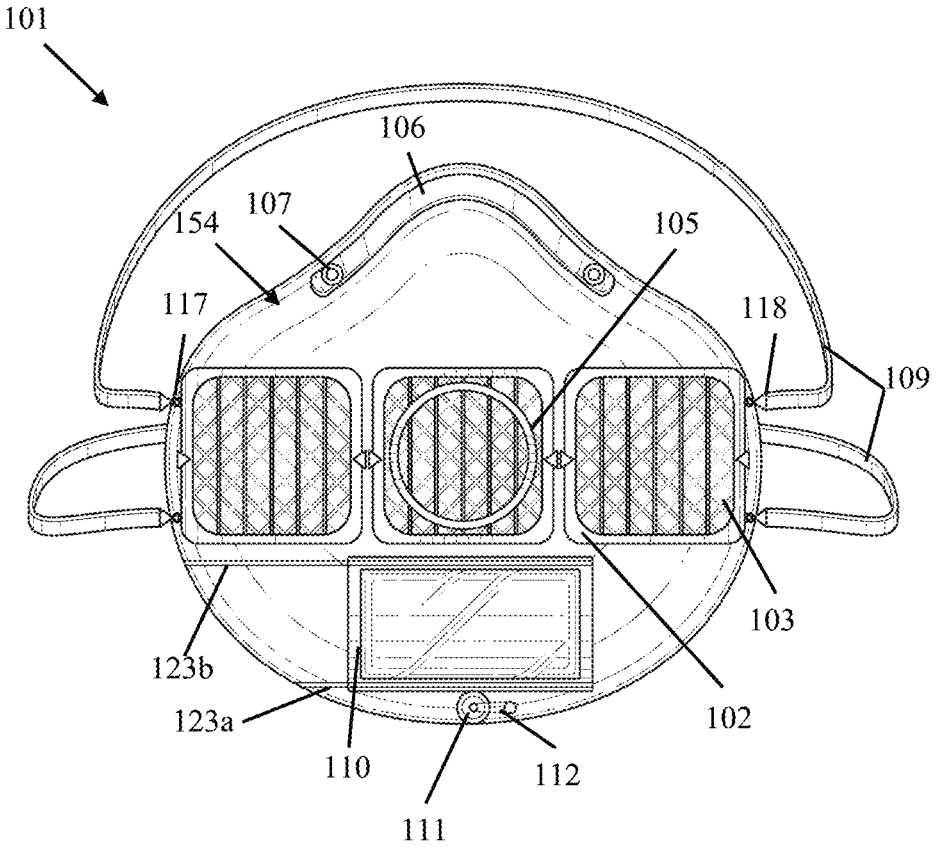
FIG. 1 illustrates the front view of the respirator oxygen mask, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the front view of the respirator oxygen mask ("mask," "respirator mask," "filtering mask") 101, according to an aspect. The respirator oxygen mask 101, having a straw opening with a cover 111, a mask opening cover 110, filter holders 102, and air filters 103 (as depicted by the crisscrossed pattern) is provided. The straw opening allows a straw to penetrate the mask, while the user is still wearing the mask 101 meaning the user is able to drink from a straw while still wearing the respirator oxygen mask 101. The respirator oxygen mask 101 has a mask gate 110 that can move from an open to closed position, which may allow the user to eat or speak while still wearing the mask 101. The filter holders 102 of the respirator oxygen mask 101 allow the filters 103 to be held in place and also allows the filters to be removed easily.

The respirator oxygen mask 101 having air filter holders 102, air filters 103, a straw opening ("straw hole") 351 (which will be described in more detail in reference to FIG. 3) with a straw opening cover ("straw hole cap," "cap") 111 and strap 112, hose attachment ring 105, noseband ("band") 106, mask gate 110 is described herein. As it will be described in more detail hereinafter, these mask components cooperate to allow the user to be safe while also performing typical daily actions. The filter holder 102 may attach to the mask 101, which may hold the air filter 103 in place. For example, the face mask 101 may be made from eco-friendly bio-based polymers to prevent the user from being in contact with other typical toxic mask materials. In another example, the mask 101 may have three filters 103. The air filter 103 may be two-way filtering, which allows the user to have the air they breathe in filtered in addition to their exhaled air be filtered limiting contamination between people. The two-way filter, as known in the art, may be used to allow the user to have filtered air for both inhaling and exhaling. It should be understood the filter 103 may also be a multilayer filter, for example having a carbon layer and a germ and COVID-19 killing layer (a layer impregnated with a germ-killing solution).

The mask body 154 may be made from typical mask material mediums, such as cloth, paper, or plastic. The body of the mask, mask body 154, may be made of a different material from the mask attachments, such as fabric or paper. The mask body 154 may prevent containments from penetrating the mask 101, while the filters 103 further prevent containments from spreading to the user or the people surrounding the user. The respirator oxygen mask 101 may have the three-filter configuration, as shown, which may allow for more flexibility in the mask along with a more comfortable fit. In another example, the filter 103 and filter holder 102 may be a single large rectangle across the front face of the mask.

The placement of multiple filters 103 may further allow better oxygen flow to the user would have a larger breathable surface area. As described herein, the filter 103 may also be any material that can filter air, such as the mask body 154, and the filter 103 does not need to be different from the mask material. Furthermore, the multiple filters 103 allow for improved sound travel, which may help communication while the user is speaking. Additionally, the three filters 103 may not come into contact with the wearer's face, thus limiting contamination. For example, the filter 103 may be removed by the user when wearing gloves to further ensure less contamination. Current masks typically only have a filter in the center of the mask or alternatively on each side of the mask, meaning there is less oxygen flow for the user to breathe in. The limited number of filters and smaller sized filters on typical masks reduce the airflow to the wearer.

The noseband ("band") 106 may allow the user to adjust the tightness of the mask around the user's nose, which may help form an airtight seal. The noseband 106 may be a flexible metal nose support. The noseband 106 may also be removable, which allows the user to microwave the mask 101, or perform other cleaning methods to wash and disinfect the mask 101. In an example, the noseband 106 may also be a stylish decorative strip, such as the noseband 106 having a different color or pattern on its surface. In another example, the noseband 106 may also be used as a label and have a user's name, title, or company name. For example, the noseband 106 may have a snap button 107 coupled with a corresponding part on the mask 101, which may allow the band 106 to be attached and removed from the mask 101.

The mask 101 may also have mask straps 109 that are able to be detached from the mask 101 to allow the user to change the mask straps 109 if necessary. The mask straps 109 may to go around the back of the head or may have shorter straps that connects around the ears. For example, the mask straps 109 may be replaced if they are worn out or if the user wishes to change the style of the mask strap 109. The mask 101 may also have a removal strap connection holes 117, for example a snap clip, which may allow the mask strap 109 to connect to a corresponding connector 118 on the mask strap 109. For example, mask straps 109 may be connected or a wide band flexible strap similar to what might be used on a snow ski goggle or motorcycle goggles may be used.

As shown in FIG. 1, the mask 101 also has a sliding door ("mask gate", "sliding door mask gate") 110 on the front of the mask that allows the user to eat through a mask opening 110*a* (not shown) when the door 110 is open. The sliding door 110 may slide along an upper track 123*b* that is attached to the face mask and the lower track 123*a*. This opening ("mask opening", "open hole portal") 110*a*, covered by the sliding door 110, allows a user to wear a protective mask at the same time be able to eat and still allowing for some air filtration.

Figure 3:
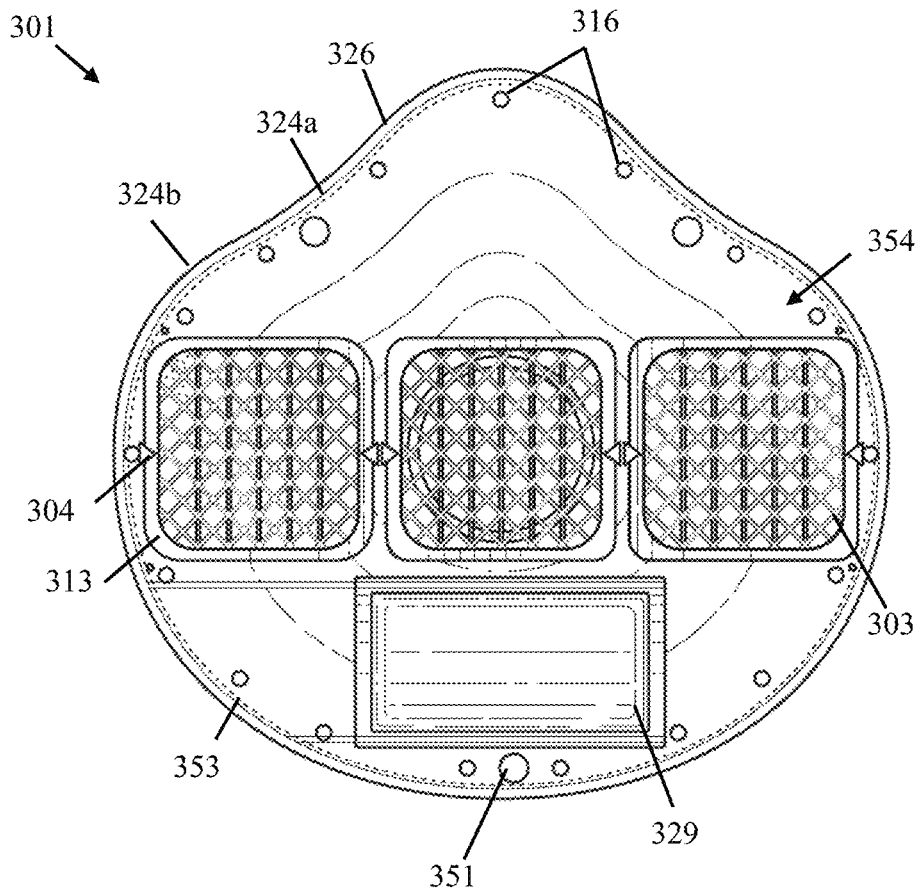
FIG. 3 illustrates the rear view of the respirator oxygen mask with the filter, according to an aspect.

The mask 101 may also have a straw opening cover 111, which may snap on to cover the straw hole (not shown). For example, the straw opening cover 11 may be a friction airtight straw portal cap. The straw opening cover 111 may also be attached to the mask 101 by a straw opening cover strap 112. The straw opening cover 111 may cover the straw opening 151 when a user is not using the straw opening. The straw opening cover 111 creates a seal, which prevents unfiltered air from entering the mask. The straw opening (as shown in FIG. 3) may be an opening on the mask 101, which may allow a straw to penetrate the mask. Moreover, the mask 101 may be made from an eco-friendly bio-based polymer, which prevents the user from breathing in toxic microplastic particles.

Figure 2:
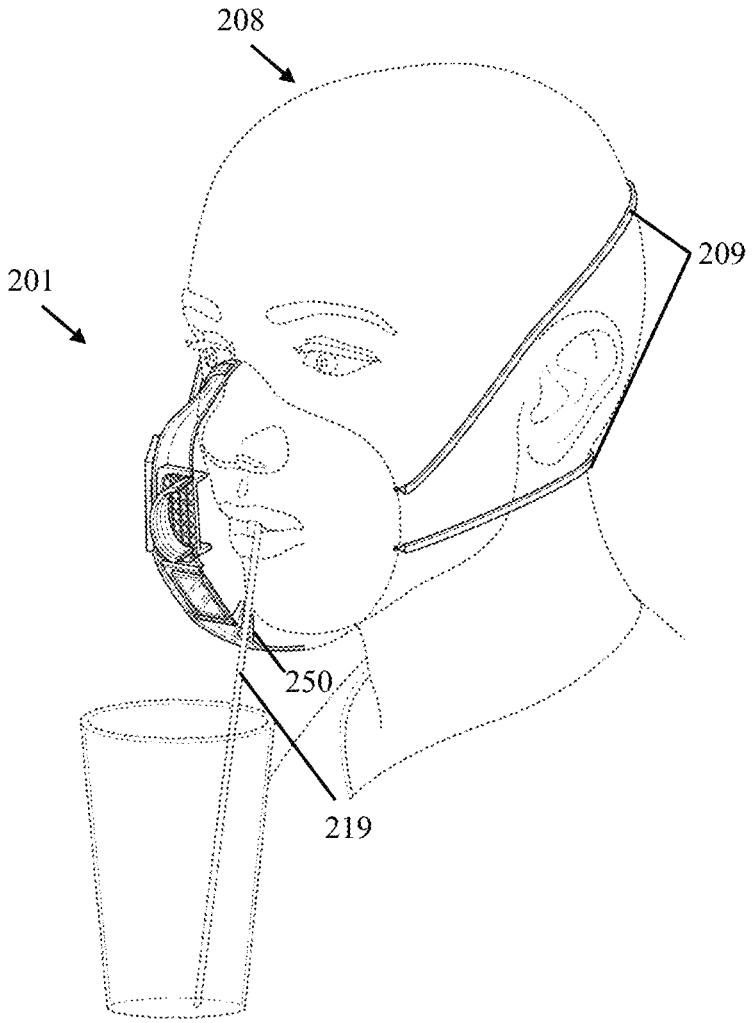
FIG. 2 illustrates the perspective side view of the respirator oxygen mask on a user, according to an aspect.

FIG. 2 illustrates the perspective side view of the respirator oxygen mask 201 on a user 208, according to an aspect. As shown, the respirator oxygen mask 201 may have two mask straps 209 to wrap around the user's head 208. The straw tube ("straw attachment") 250 may allow an airtight seal around a straw 219 because of its conical shape. For example, a variety of different sized diameter straws may be used and also may create an airtight seal due to the straw tube 250. In an example, the straw attachment 250 may have a snap in friction locking mechanism, which will be discussed in more detail when referring to FIG. 7. In another example, the straw tube 250 may be molded into the mask 201. Furthermore, the molded straw attachment may be 0.25 inches long.

The straw tube 250 may allow multiple sized diameter straws to be used and still maintain an airtight seal, compared to other mask that have a slit or a hole, which do not create an airtight seal. The airtight seal from the straw attachment 250 allows users to drink from a straw 219, while still wearing the mask 201. Thus, protecting the user from unfiltered air particles while consuming a beverage through the straw 219. The mask 201 with the mask straw attachment 250 may be valuable to patients, health care workers, and others to stay hydrated while practicing health and safety measures during hazardous conditions, such as air born viruses, the COVID-19 pandemic, or when a user is exposed to hazardous air or dust. The straw attachment may be a smaller size than a typical straw and the straw 219 may be pushed through the straw tube 250 to ensure an airtight seal. For example, the mask straw attachment 250 may be a stretchable material (e.g., rubber, a thin rubber). The stretchable material of the straw tube 250 may allow the user to push a variety of straw sizes through the straw tube 250 to easily drink while wearing the mask 201.

FIG. 3 illustrates the rear view of the respirator oxygen mask 301 with the filter 303, according to an aspect. As shown in FIG. 3, the mask 301 has an air filter holder 302 with the filter 303 attached to it. For example, the filter 303 may be a replaceable pad filter, which would allow the user to replace the filter 303 at will, such as on a daily basis or whenever they deem it necessary. Furthermore, the air filter 303 may be an FDA approved material and, for example, may have an adhesive on one side to assist holding it in place within the air filter holder 302 prior to the air filter cover (not shown) being applied. The easy replacement of air filters 303 may be safer and more environmentally friendly for a user than a cloth mask, paper mask, or an N95 mask with an air valve. The filter 303 filters the user's inhale from particles, such as dust, smoke, bacteria, and other airborne contaminants. The filter 303 may also filter the breath of the user when they exhale, thus not spreading harmful particles from the user to another person. As described here, the filter 303 may be removed to allow the mask 301 to be sanitized, for example, by being washed in a dishwasher, or by using a chemical disinfectant.

The mask opening, behind the interior mask door 329, and the straw opening 351 are disposed in the mask body 354 with the mask opening disposed above the straw opening to allow an inserted straw to have an appropriate angle to the user's mouth. The straw opening 351 being disposed underneath the mask opening allows for a more natural drinking angle while the user is drinking from a straw inserted into the straw opening 351. The straw opening 351 may have a v-shape, or conical shape, tapering inwards mask straw attachment 350 inserted into the straw opening 351. This snug fit created by the mask straw attachment allows a tight seal to prevent user from breathing unfiltered air even while using the straw (not shown), as described when referring to FIG. 7.

The mask 301 may also have the ability to reduce in size to accommodate a smaller face. A face mask reduction attachment 326 may be attached to the mask 301 to allow the mask 301 to fit smaller head shapes. For example, the face mask reduction attachment 326 may be made from a pliable and flexible material to conform to the smaller shaped heads. A connector 316 may be used to attach the mask 301 to the face mask reduction attachment 326 to have an airtight seal on a smaller user. For example, the connector 316 may be female snap on friction fitting connector with a corresponding male snap on friction fitting on the face mask reduction attachment 326 to join the mask 301 to the face mask reduction attachment 326. The face mask reduction attachment 326 may have corresponding connectors to attach to the connectors 316 on the mask 301. The connectors 316 may provide an airtight connection between the mask 301 and the reduction attachment 326. The face mask reduction attachment 326 may be applied to the mask by attaching to the mask edge 324*a* via the connectors 316. With the face mask reduction attachment 326 in place, the new mask edge 324*b* may form to the contours of a user with a smaller face. The face mask reduction attachment 326 may be molded to the user's face contours.

The face mask reduction attachment edge ("new edge") 324*b* on the face mask reduction attachment 326 may allow the mask 301 to be used by a different user once the mask is sanitized. For example, after the mask 301 is cleaned and sanitized another person may use the mask 301, such as a health care worker with a smaller sized face. The face mask reduction attachment edge 324*b* on the face mask reduction attachment 326 creates a tight seal between the mask 301 and the user's face, which may prevent unfiltered air to pass through the edge of the mask. For example, the face mask reduction attachment 326 may also have a support brackets to increase the sturdiness of the face mask reduction attachment 326. In another example, the face mask reduction attachment 326 may be more conforming to the user's face, such as accommodating more face shapes and contours and face sizes. The mask may also have a face contact edge 353 (as depicted by the dotted line), which will be described in more detail when referring to FIG. 5.

Furthermore, the filter cover 313 may connect to the filter holder 302 by coupling 304. The filter cover 313 allows the filter 303 to be held in place while filtering the bacteria, dust, and other harmful substances. For example, the filter cover 313 may have push pin snap couplings 304 to allow the user to lock filter cover 313 tightly in place with the filter holder 302. The couplings 304 may also allow the filter cover 313 to be easily removed when necessary, such as when the filter 303 needs to be replaced. As shown in FIG. 3, the mask 301 may have an interior mask door 329, which will be described in more detail when referring to FIG. 4.

Figure 4:
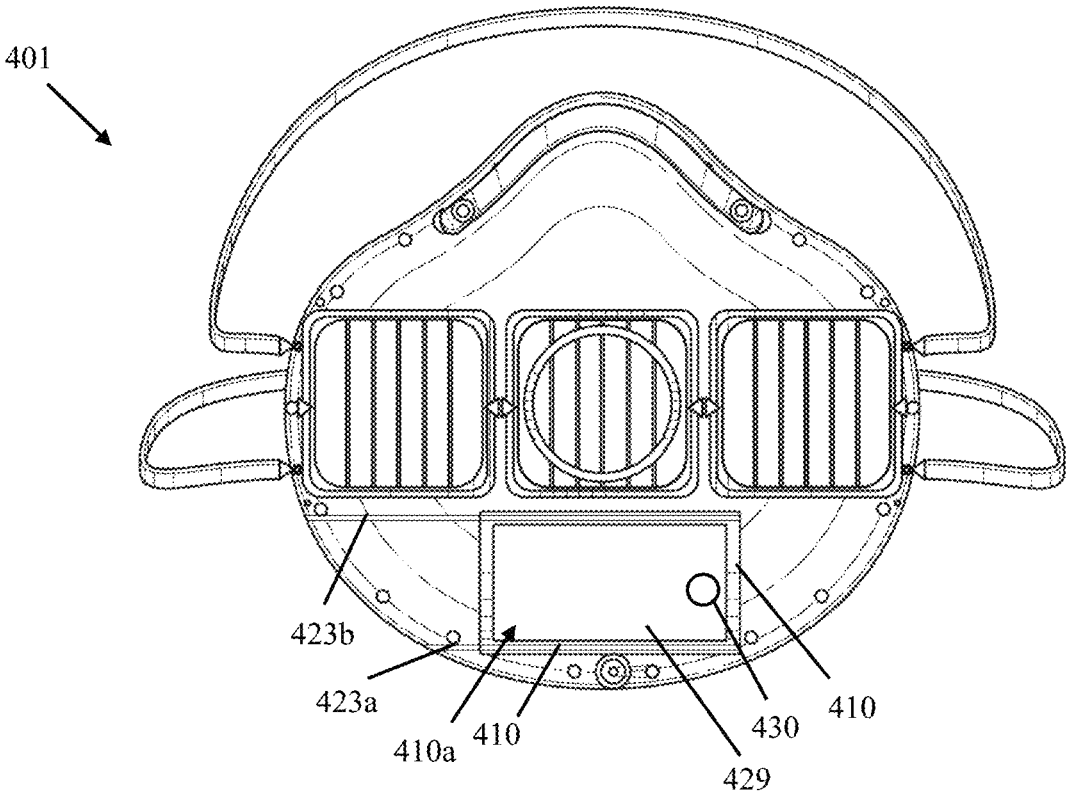
FIG. 4 illustrates the front view of the respirator oxygen mask without the filter, according to an aspect.
Figure 6:
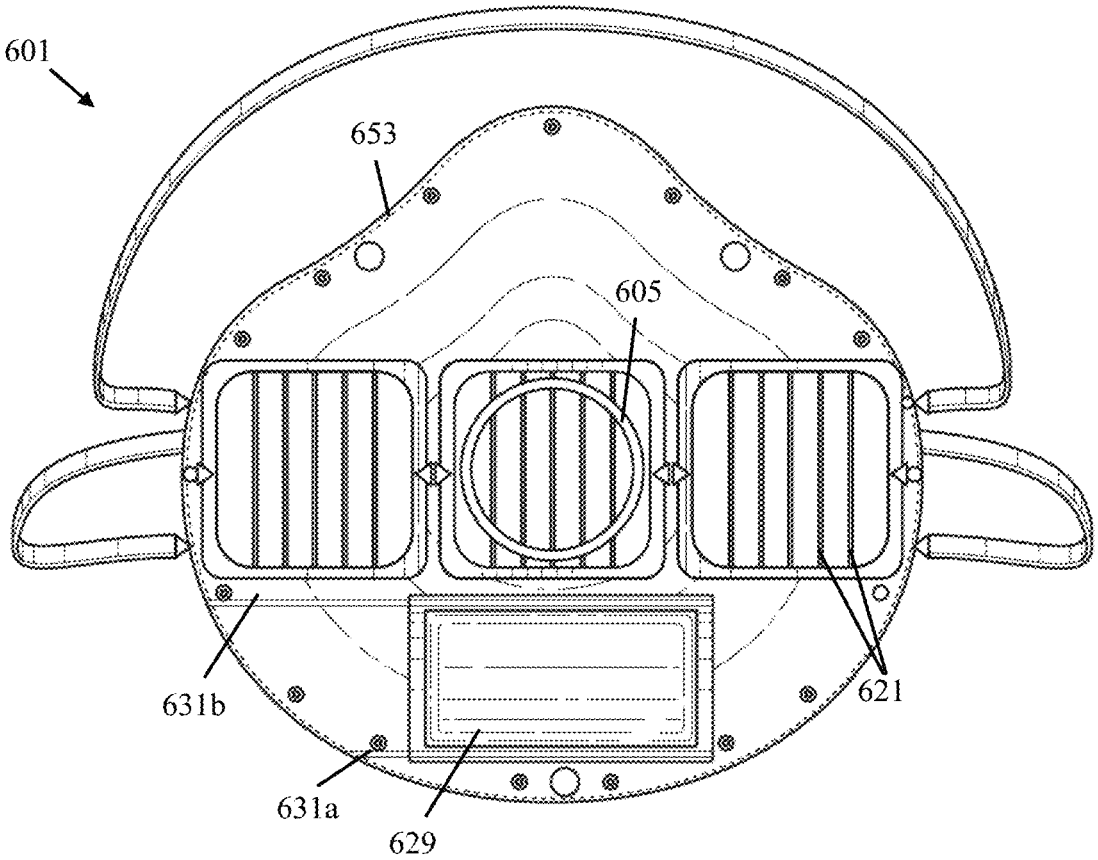
FIG. 6 illustrates the rear view of the respirator oxygen mask without the filter, according to an aspect.

FIG. 4 illustrates the front view of the respirator oxygen mask 401 without the filter, according to an aspect. The respirator oxygen mask 401 may have a clear sliding door 410 with the interior mask door ("interior mask sliding door," "second sliding door") 429 behind it, as shown. Between the sliding door and the interior mask door 429, the respirator oxygen mask 401 has a mask opening 410*a*. The mask opening 410*a* may allow the user to better speak and eat while still wearing the mask, once the two sliding doors have been slid into the open position. The interior mask door 429 may also have a handle, as shown in FIG. 4 to allow the user to open and close the interior mask door 429 easily. The handle 430 may be on the exterior surface of the mask door 429, as shown in FIG. 6. In another example, the interior mask door 429 may also be clear material allowing the user's mouth to be seen, which may help with communication.

The respirator oxygen mask 401 may have an upper track 423*b* and a lower track 423*a* for the mask gate 410, which covers the mask opening 410*a*, and in this example is a clear material. The tracks 423*b* and 423*a* may allow the mask gate 410 to slide back and forth between a closed and opened position. For example, the track may have a friction ridge to lock the mask gate 410 into the open or closed position. The user being able to eat while still wearing the mask allows the user to spread less bacteria particles from their nose compared to if a user needed to completely take of the mask to eat. The mask opening 410*a* may also allow the user to have urgent unobstructed conversations. Current masks block voice transfer making it harder to hear a person talking with a mask on. For example, clear speech is critical when a health care worker may be giving medical instruction, thus the mask opening 410*a* would help relay important instructions.

Figure 5:
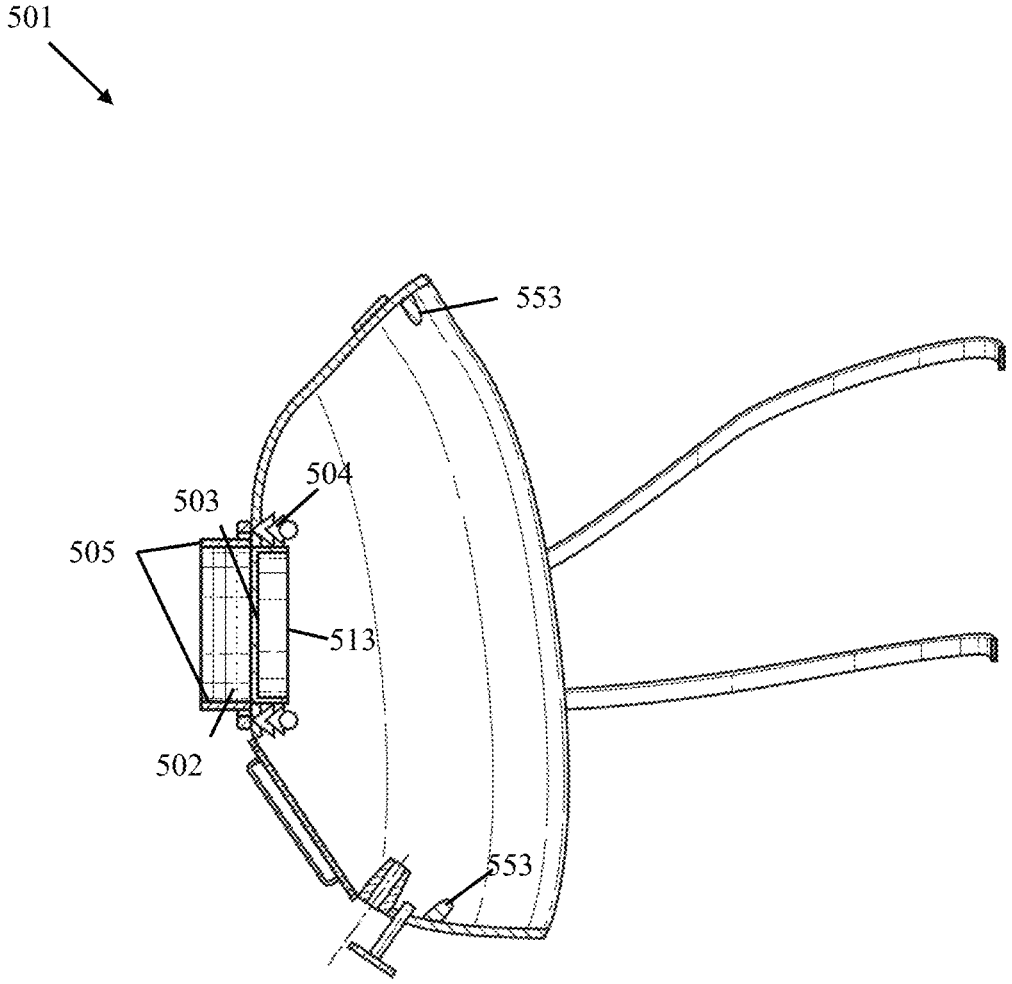
FIG. 5 illustrates the side view of the respirator oxygen mask, according to an aspect.

FIG. 5 illustrates the side view of the respirator oxygen mask 501, according to an aspect. As shown, the air filtration portion in the center of the mask 501 has multiple layers, such as the filter 503, hose attachment ring 505, filter cover 513, and the filter holder 502. Furthermore, the air filter cover 513 may have support bars, as shown in FIG. 4, which may further allow the air filter 503 to be sandwiched between filter holder 502 and the filter cover 513. As shown, in an example, the filter cover 513 may snap into filter holder 502 by the friction coupling 504.

The filter cover 513 allows the filter 503 to be held snugly in place to create an airtight seal around the air portal on the mask 501. The filter cover 513 may be more securely held in place by the coupling 504. For example, the coupling 504 may be a push pin-snap coupling and may allow the user to easily change the filter 503 daily as recommended by the CDC.

Typically, personal protective equipment usually comes into contact with a large surface area of the user's face, which is uncomfortable and typically causes irritation to the user. This irritation usually causes a rash or a breakout of pimples. As shown, the face contact edge 553 of the mask 501 may be bull nose shaped. The bullnose shape may allow minimal face contact of the mask to user's face. Currently, there is an issue with people wearing masks for extended periods and too much surface area of the mask may be in too much contact with the user's face. Typically, this causes to the user's skin to be irritated. The bull nose shape may allow minimal contact between the user's face and their mask. The face contact edge 553 masks also may slightly indent into the user's skin allowing for a better airtight seal rather than the typical flat surface edge.

FIG. 6 illustrates the rear view of the respirator oxygen mask without the filter, according to an aspect. As shown, FIG. 6 has the hose attachment ring 605 through the support bars 621, as an example. As shown as another example, the mask 601 may also have an interior mask door 629 flush against the sliding door 610 with the mask opening 610*a* between them, which may allow for a better airtight seal. The interior mask door 629 may also have an upper track 631*b* and a lower track 631*a* for the interior mask door 629 to move from an opened to closed position. For example, the upper track 631*b* and lower track 631*a* may be a friction ridge track to better seal the mask and prevent unfiltered air from traveling into the mask 601. Furthermore, interior mask door 629 in the mask 601 may slide open and close to allow the user to eat or hold a conversation without voice restrictions. The interior mask door 629 may also have a handle, as shown in FIG. 4, to allow the user to open and close the interior mask door 629 easily. As described in FIG. 5, the mask 601 may have a face contact edge 653, and as shown, the face contact edge 653 may be a protruding edge around the entire interior of the mask 601.

Figure 7:
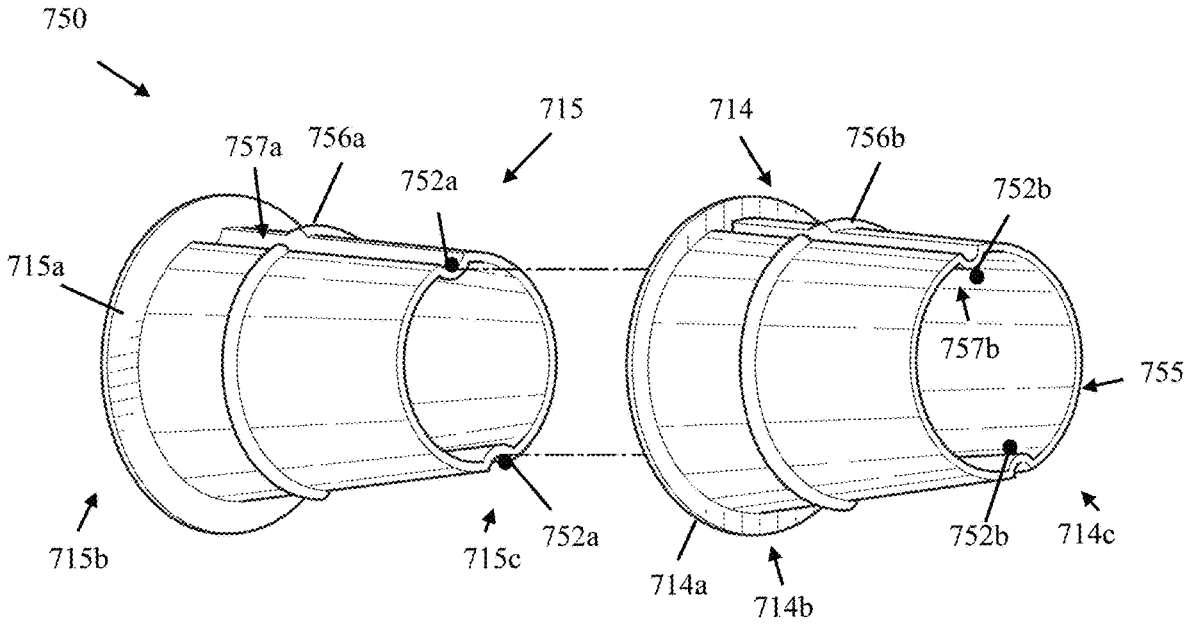
FIG. 7 illustrates the perspective view of the mask straw attachment, according to an aspect.

FIG. 7 illustrates the perspective view of the mask straw attachment 750, according to an aspect. As shown, the mask straw attachment 750 may be two components, the interior straw opening component 714 and the exterior straw opening component 715, which may interlock with each other by securing protrusions 752*a*, 752*b* within a channel 757*a* and beam 757*b*. The interior straw opening component 714 being adapted to slide onto the exterior straw opening component 715 to create an airtight seal. The interior straw opening component 714 may also slide onto a portion of the mask body to sandwich it between the two straw attachments further creating the airtight seal. The conical shape of the interior straw opening component 714 and the exterior straw opening component 715 allow for an airtight seal between the walls of the mask straw attachment 750 and an inserted straw. The mask straw attachment 750 creates an airtight straw channel 755 for multiple sized straws to be used. Additionally, the mask body may be squeezed between the flanges 714*a*, 715*a* to create a seal between the mask and mask straw attachment 750.

Furthermore, the interior straw opening component having a first flange 714*a* disposed at a first end 714*b*, and a beam 757*b* extending from the first flange 714*a* to an opposite second end 714*c* of the interior straw opening component. While the exterior straw opening component has a second flange 715*a* disposed at a first end 715*b*, and a channel 757*a* extending from the second flange 715*a* to an opposite second end 715*c* of the exterior straw opening component. Additionally, the exterior straw opening component is adapted to fit through the straw opening and snugly into the interior straw opening component such that the beam 757*b* slides into the channel 757*a*, thus creating a friction seal between the exterior straw opening component and the interior straw opening component, and such that the first flange 714*a* and the second flange 715*a* constrain therebetween a portion of the mask body surrounding the straw opening, thus creating a friction seal between the mask body and the mask straw attachment.

For example, the channel 757*a* may extend from one end to the opposite end of each piece of the mask straw attachment 750. In another example, the channel 757*a* may extend from the end opposite of the second flange 715*a* of the exterior straw component 715 only for a portion of the length of the exterior straw component 715 and correspondingly the beam 757*b* on the interior straw component 714 may extend from the flange 714*a* end over a portion of the length of the interior straw component 714.

In an example, the interior straw opening component 714 and the exterior straw opening component 715 may lock together by securing protrusions 752*a*, 752*b*. The beam may have a first securing protrusion 752*b*, while the channel 757*a* may have a second securing protrusion 752*a* to allow the beam 757*b* to slide into the channel 757*a* and the first securing protrusion 752*b* slides passed the second securing protrusion 752*a*. Moreover, the second securing protrusions 752*a* on the exterior straw opening component 715 and the first securing protrusions 752*b* on the interior straw opening component 714 may allow for the interior straw opening component 714 to slide onto the exterior straw opening component 715 and lock into place. The interior straw opening component 714 and its securing protrusions 752*b* would slide past the securing protrusions 752*a*, which may prevent the interior straw opening component 714 from easily coming off of the exterior straw opening component 715. The securing protrusions 752*a*, 752*b* may restrict backwards movement to ensure a stronger connection between the interior straw opening component 714 and the exterior straw opening component 715.

In another example, the interior straw opening component 714 and the exterior straw opening component 715 may lock together by a bump ridge 756*a* on exterior straw opening component 715 and a bump channel 756*b* on interior straw opening component 714. The bump ridge 756*a* may be a protrusion on exterior straw opening component 715, while the bump channel 756*b* may be an indentation on the interior straw opening component 714. When sliding the interior straw opening component 714 onto the exterior straw opening component 715, the bump channel 756*b* may snap onto the bump ridge 756*a*.

Figure 8:
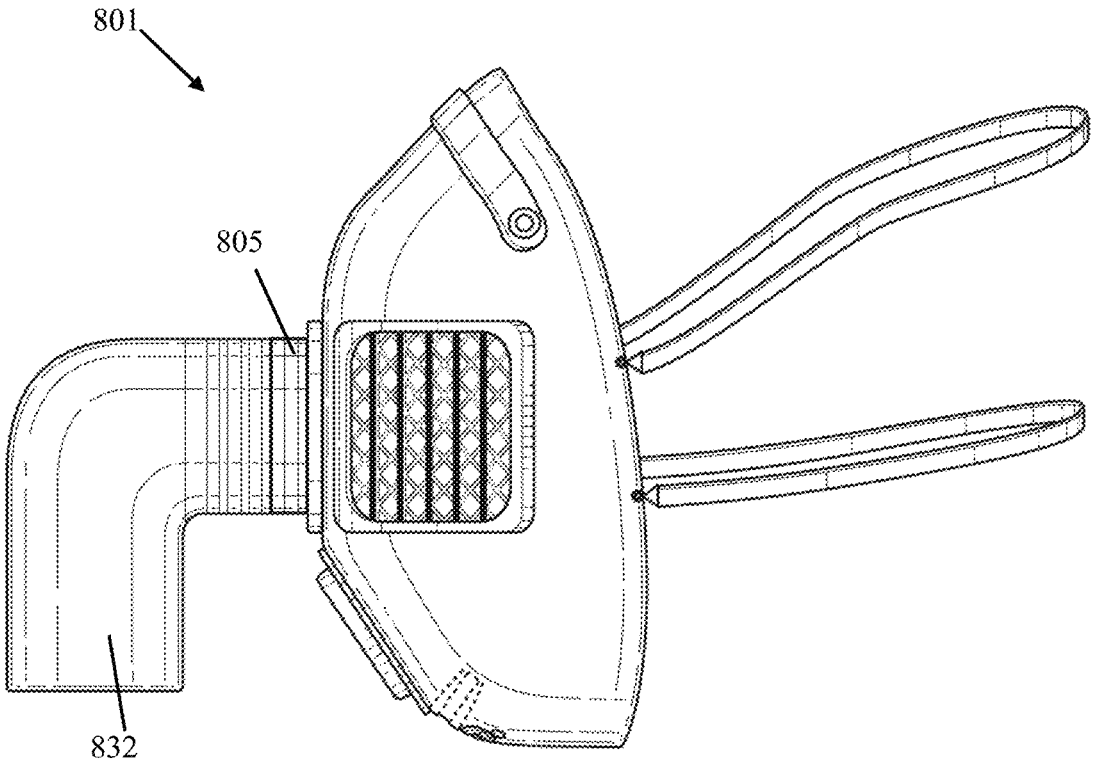
FIG. 8 illustrates the side view of the respirator oxygen mask with the tube attachment, according to an aspect.

FIG. 8 illustrates the side view of the respirator oxygen mask with the tube attachment ("hose attachment") 832, according to an aspect. The mask 801 may have a hose attachment ring 805 for tube attachment 832. For example, the hose attachment ring 805 may be a threaded coupling to fasten to the tube attachment 832. The tube attachment may be a ninety-degree elbow to provide the user with oxygen. For example, the hose attachment ring 805 with the tube attachment 832 may fasten to an oxygen line ("oxygen hose tube," "oxygen hose") with a male coupling, such as a snap on configuration. Currently, oxygen masks have very little to prevent the spread of bacteria and virus particles. Typical oxygen masks do not have exhaust or exhale air filters. The use of mask 1 with the tube attachment 832 may allow the user to receive oxygen without the risk of spreading bacteria and viruses. The tube attachment 832 may have a threaded or snap-on coupling system to attach the tube attachment 832 to the mask 801. The combination of the mask 801 and the tube attachment 832 allows user to receive necessary treatment without compromising the user's protection from harmful bacteria or viruses. Furthermore, the respirator oxygen mask 801 coupled with the hose attachment 832 may supply the user with any necessary treatment prescribed by a medical professional. For example, the mask may connect to an oxygen tank, oxygen generator or the like of, and may be suitable for individuals who need more oxygen (e.g., doctor prescribing oxygen use for older patients). Moreover, the hose attachment ring 805 with the tube attachment 832 may allow for a decrease in trapped heat and sweat because when the user exhales their breath easily filters and flows out of the mask.

Figure 9:
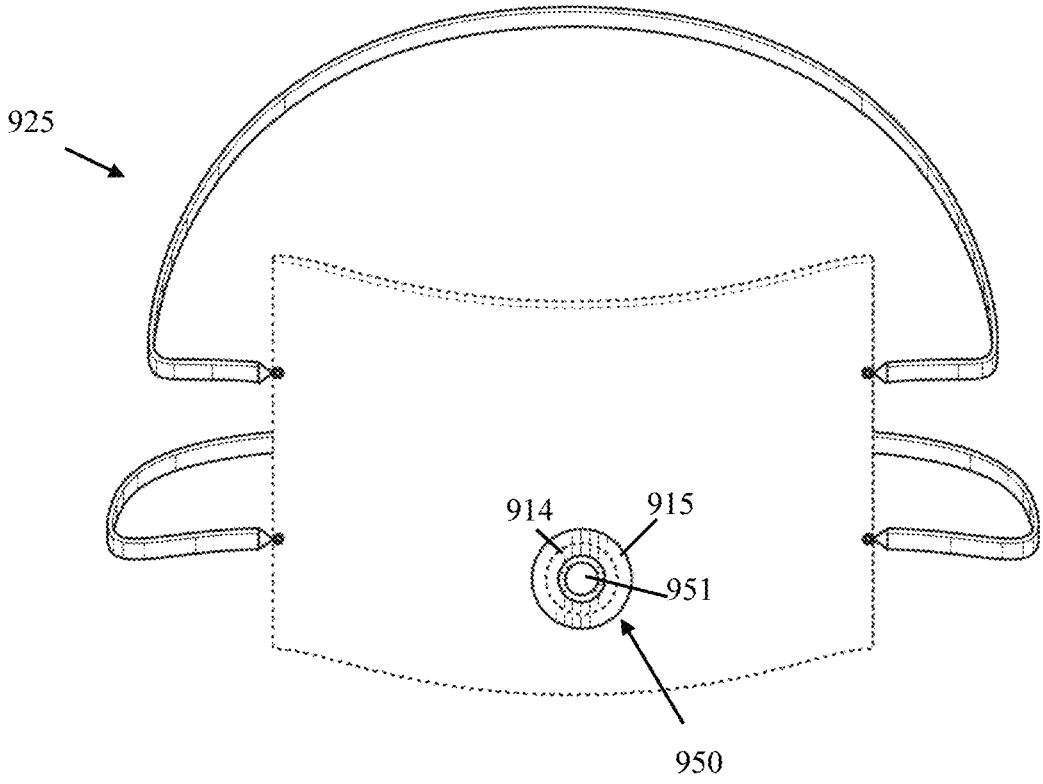
FIG. 9 illustrates the front view of the cloth respirator oxygen mask with the tube attachment, according to an aspect.

FIG. 9 illustrates the front view of the cloth respirator oxygen mask 925 with the tube attachment 950, according to an aspect. As shown, the cloth mask configuration 925 has the straw attachment 950 which may have a two-piece friction snap together fitting, as shown in FIG. 7. The addition of the straw attachment 950 on the cloth mask configuration 925 may allow a user to drink from a straw that may be pushed through the mask 925. The cloth mask configuration 925 may be easily installed and removed any style masks, for example paper, cloth, or plastic masks.

The interior straw opening component 914 may have a conical shape, with a first and second opening, wherein the first opening is smaller than the second opening. The exterior straw opening component 915 have a conical shape, with a third and fourth opening, wherein the third opening is smaller than the fourth opening. The interior straw opening component 914 may attach to the exterior straw opening component 915 forming the straw opening 951. The second opening and the third opening being the same size to allow for an airtight seal.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A respirator oxygen mask comprising:
- a filter;
- a mask body;
- a mask opening disposed in the mask body, wherein the mask opening is disposed above the straw opening;
- the straw opening having:
  - a mask straw attachment having a straw channel, the mask straw attachment being made of a stretchable material and having a conical shape thereby being adapted to sealably receive through the straw channel various sized straws;
  - a straw opening cover removably attached to the mask straw attachment;
- an outer edge;
- a mask strap adapted to attach to the outer edge;
- a face mask reduction attachment, wherein the face mask reduction attachment is adapted to fasten to the outer edge;
- a front surface having:
  - a first sliding door, wherein the first sliding door is adapted to cover the mask opening;
  - a hose attachment ring disposed over the filter and adapted to receive a tube;
  - a nose band disposed on an upper portion of the mask corresponding to a user's nose;
- a rear surface having:
  - a face contact edge disposed along a rear surface edge, the face contact edge having a bullnose shape and being adapted to rest on a user's face, thus keeping the mask body away from the user's face;
  - a second sliding door, wherein the second sliding door is adapted to cover the mask opening;
  - a filter holder attached to the mask;
  - a filter cover, wherein the filter cover couples to the filter holder; and
  - the filter holder and the filter cover are adapted to secure the filter in place.

2. The respirator oxygen mask of claim 1 further comprising:
- an exterior upper track and lower track, wherein the first sliding door is adapted to engage with and slide along the exterior upper track and lower track; and an interior upper track and lower track, wherein the second sliding door is adapted to engage with and slide along the interior upper track and lower track.

3. The respirator oxygen mask of claim 1, wherein the face mask reduction attachment has a male connector.

4. The respirator oxygen mask of claim 3, wherein the respirator oxygen mask has a female connector adapted to fasten the male connector on the face mask reduction attachment.

5. The respirator oxygen mask of claim 1, wherein the straw opening cover has a strap attached to both the straw opening cover and the respirator oxygen mask.

6. The respirator oxygen mask of claim 1, wherein the mask strap has a connector adapted to connect to the respirator oxygen mask.

7. The respirator oxygen mask of claim 1, further comprising a hose attachment adapted to attach to the hose attachment ring.

8. The respirator oxygen mask of claim 1, wherein the face mask reduction attachment is adapted to be molded to the user's face.

9. A respirator oxygen mask comprising:
- a filter;
- a mask body;
- a mask opening and a straw opening disposed in the mask body; wherein the mask opening is disposed above the straw opening;
- a sliding door adapted to cover the mask opening;
- the straw opening having:
  - a mask straw attachment adapted to receive a straw;
  - a straw opening cover removeably attached to the mask straw attachment;
- an outer edge;

a mask strap adapted to attach to the outer edge;

a face mask reduction attachment, wherein the face mask reduction attachment is adapted to fasten to the outer edge and is selectively and removably attached to the mask body;

a front surface having:

a hose attachment ring disposed over the filter and adapted to receive a tube;

a rear surface having:

a face contact edge disposed along a rear surface edge, the face contact edge having a bullnose shape and being adapted to rest on a user's face, thus keeping the mask body away from the user's face;

a filter holder attached to the mask;

a filter cover, wherein the filter cover couples to the filter holder; and the filter holder and the filter cover are adapted to secure the filter in place.

10. The respirator oxygen mask of claim 9, wherein the straw opening cover is attached to the mask by a strap.

11. The respirator oxygen mask of claim 9, wherein the face mask reduction attachment is adapted to couple with the outer edge of the respirator oxygen mask using a snap on friction fitting connector.

12. The respirator oxygen mask of claim 9, wherein the filter is a two-way filter.

13. The respirator oxygen mask of claim 9, wherein the respirator oxygen mask has three filter holders.

14. The respirator oxygen mask of claim 13, wherein the respirator oxygen mask has three filters.

15. The respirator oxygen mask of claim 9, wherein the sliding door is adapted to slide along an upper and lower track.

16. The respirator oxygen mask of claim 9, wherein the mask body is an eco-friendly bio-based polymer.

17. A mask comprising:

a mask body;

a straw opening disposed in the mask body;

a mask straw attachment having:

an interior straw opening component having a conical shape, a first flange disposed at first end, and a beam extending from the first flange to an opposite second end of the interior straw opening component;

an exterior straw opening component having a conical shape, a second flange disposed at the first end, and a channel extending from the second flange to an opposite second end of the exterior straw opening component;

wherein the exterior straw opening component is adapted to fit through the straw opening and into the interior straw opening component such that the beam slides into the channel, thus creating a friction seal between the exterior straw opening component and the interior straw opening component, and such that the first and second flanges constrain therebetween a portion of the mask body surrounding the straw opening, thus creating a friction seal between the mask body and the mask straw attachment; and a straw channel, the mask straw attachment being made of a stretchable material and having a conical shape thereby being adapted to sealably receive through the straw channel various sized straws.

18. The mask straw attachment of claim 17, further comprising:

the beam having a first securing protrusion;

the channel having a second securing protrusion; and wherein the beam slides into the channel and the first securing protrusion slides past the second securing protrusion.

19. The mask straw attachment of claim 17, further comprising:

the interior straw opening component having a bump channel;

the exterior straw opening component having a bump ridge; and wherein the interior straw opening component and the exterior straw opening component are adapted to secure together by the bump ridge engaging with bump channel.

* * * * *